United States Patent [19]

Spoldi et al.

[11] 4,315,232

[45] Feb. 9, 1982

[54] SUBMINIATURE AUDIO TRANSFORMER

[76] Inventors: Henry Spoldi, 43 Rockledge Rd., Bronxville, N.Y. 10708; Joseph N. Sweeney, 9 Locust La., Huntington, N.Y. 11743

[21] Appl. No.: 119,447

[22] Filed: Feb. 7, 1980

[51] Int. Cl.[3] ..... H01F 15/10; H01F 27/30

[52] U.S. Cl. ..... 336/90; 29/606; 336/83; 336/192; 336/198; 336/234

[58] Field of Search ..... 336/192, 198, 208, 213, 336/233, 234, 84 R, 84 M, 83, 90; 29/606

[56] References Cited

U.S. PATENT DOCUMENTS 708,220 9/1902 Gill ..... 336/198 X

*Primary Examiner*—Thomas J. Kozma

*Attorney, Agent, or Firm*—Kane, Dalsimer, Kane, Sullivan and Kurucz

[57] ABSTRACT

A subminiature transformer is provided. The transformer comprises a bobbin having a slit extending therethrough. The transformer core is formed of a plurality of gapless laminations each passed into the bobbin through a slit.

8 Claims, 5 Drawing Figures

SUBMINIATURE AUDIO TRANSFORMER

BACKGROUND OF THE INVENTION

The present invention relates to subminiature transformers and particularly to gapless subminiature transformers.

Conventional subminiature transformers are formed with a laminated core wherein each of the laminations is split to permit its insertion into a bobbin. The result of the split laminations, however, results in a breaking of the magnetic circuit causing inductance losses.

For studio grade audio applications, as well as certain computer applications, navigational devices, aircraft instrumentation, and the like, the inductance loss caused by the gaps in the laminations of a conventional subminiature transformer cannot be tolerated since the loss of inductance because of the air gap results in transformers having excessive leakage inductance, increased capacitance and increased resistance. As a result, various attempts have heretofore been made to provide a subminiature transformer having a gapless laminated core.

In one such prior art attempt, the windings of the transformer are toroidal. Such toroidal windings, however, do not lend themselves to uniform wire distribution and repeatability of manufacture. In addition, toroidal windings cannot readily be effected on automatic equipment. In addition, it is extremely difficult to obtain a toroidal winding with ultrafine wire (i.e., such as No. 52 wire which has a diameter on the order of 0.9 mil).

In another prior art attempt to solve the above problem, the bobbin is formed of two pieces which are assembled about the laminated core. That is, the bobbin is assembled about the laminations after the laminations are formed into a core stack. The major problem with this type of construction is that it is extremely difficult to bring the ultrafine wires of the transformer windings to the outside for interconnections.

SUMMARY OF THE INVENTION

In view of the above, it is the principal object of the present invention to provide an improved subminiature transformer of the gapless lamination type.

A further object of the present invention is to provide such a subminiature transformer which may readily be mass-produced.

A still further object of the present invention is to provide a transformer of the subminiature type wherein the ultrafine wire of the windings may readily be connected to exterior components.

The above and other beneficial objects and advantages are attained in accordance with the present invention by providing a subminiature transformer comprising an annular bobbin having an open center and top and bottom flanges. The bobbin is split parallel to the bobbin axis with the split extending from end to end of the bobbin. A plurality of gapless laminations forming a core stack are passed through the split to link with the bobbin.

At one end, a rim on the bobbin extends beyond the associated flange surrounding the center opening. A plurality of terminal members seat on the bobbin rim held in position by a cap. A plurality of wire windings extend about the bobbin with the ends of each winding being brought to a terminal through suitable cut-outs in the bobbin flange.

DETAILED DESCRIPTION OF THE PREFERRED EMBODIMENTS

Figure 1:
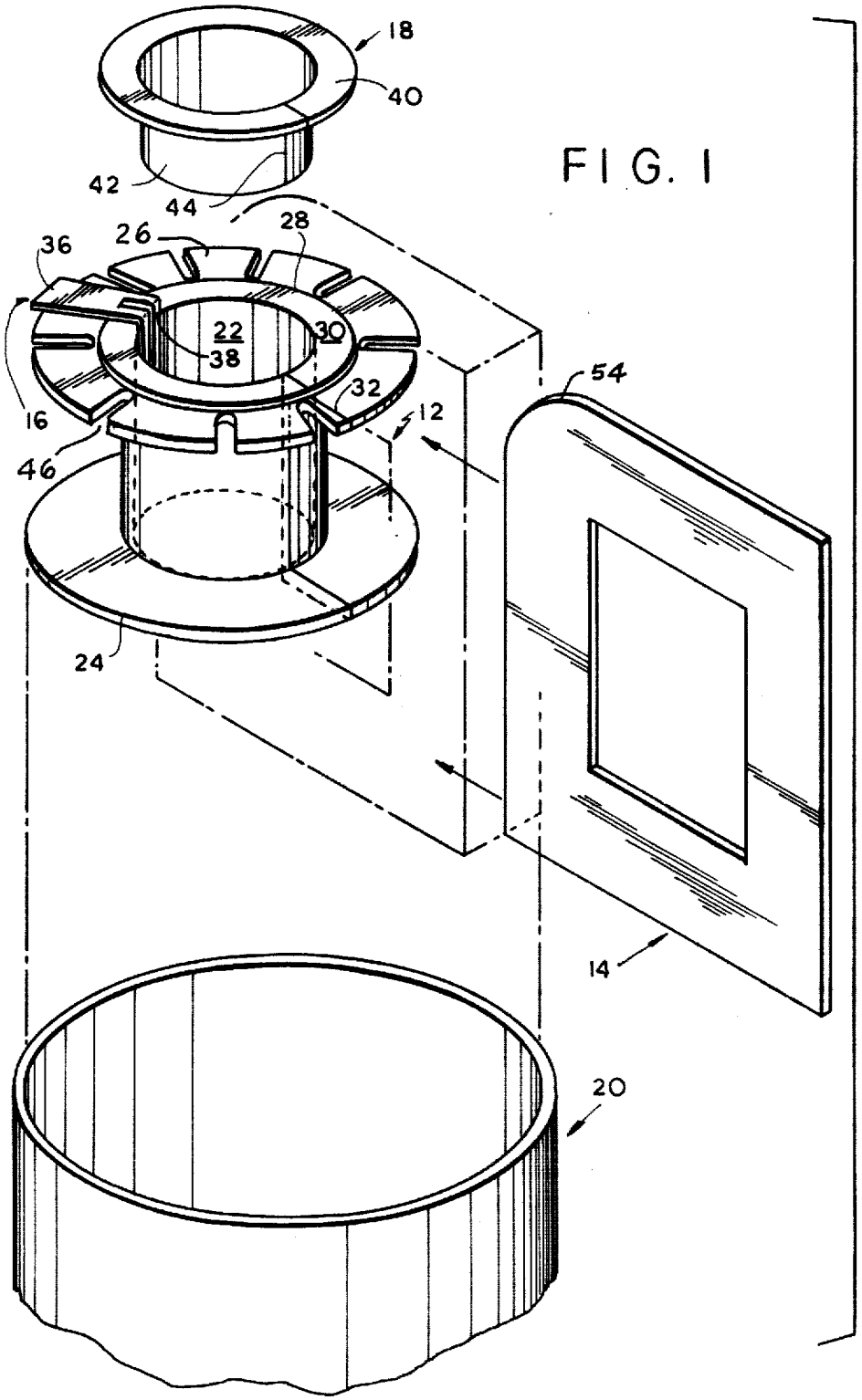
FIG. 1 is an exploded perspective view of the principal components of a transformer in accordance with the present invention.

Reference is now made to the drawings wherein several embodiments of the present invention are depicted. In FIG. 1, the principal components of a gapless subminiature transformer are shown as comprising a bobbin assembly 12, a single lamination 14, a terminal member 16, terminal retaining cap 18 and casing 20.

The bobbin 12 is conveniently formed of a plastic material and comprises an annular member having an open center section 22. The ends of the bobbin are defined by flanges 24 and 26. A rim 28 extends beyond flange 26 surrounding the center section 22 with the top surface 30 of the rim spaced above the top surface of flange 26.

An essential feature of the present invention comprises a split 32 extending entirely through the bobbin from top to bottom and from the outer surface to the open center section 22.

The transformer core stack 34 (see FIG. 3) is formed of a series of individual lamination such as the single lamination 14 depicted in FIG. 1. Each lamination 14 is linked with the bobbin as shown in FIG. 2 by passing the laminations, one at a time, through the split 32 in the bobbin.

Figure 2:
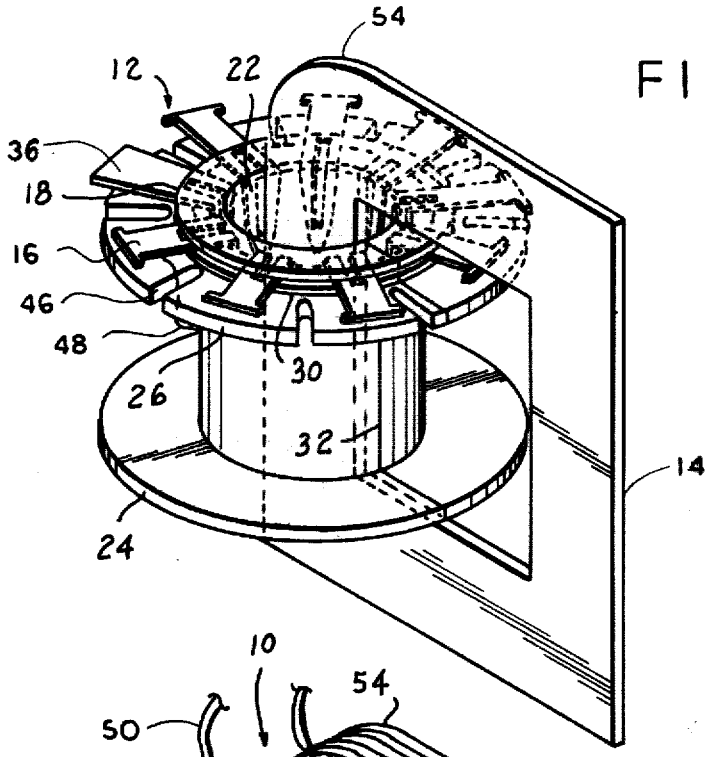
FIG. 2 is a perspective view of a partially assembled transformer showing one core lamination in position.

Referring to FIG. 2, it can be seen that a plurality of terminals 16 rest on the top surface of rim 30. The terminals 16 are each formed of a conductive material such as copper and each has a first portion 36 extending radially outwardly from center section 22 and a second portion 38 extending into the interior of the bobbin. The number of terminals 16 is determined by the number of windings to be wound about the bobbin with two terminals provided for each winding. The terminals 16 are captured in position by cap 18 which cooperates with the top surface of rim 30 forming a tight pocket into which the terminals are secured. The cap 18 comprises essentially an annular member having a flange 40 which seats on top surface 30 of rim 28 and a short shaft 42 which extends into the interior of the bobbin section. The terminals 16 are thus captured on both their radial surfaces 36 as well as longitudinal surfaces 38 between the bobbin and surfaces 40 and 42 respectively of cap 18. Cap 18 is provided with a split 44 which aligns with split 32 of the bobbin and thus enables the laminations to be linked into the bobbin after the cap is in position. In this regard it should be appreciated that the bobbin is sufficiently resilient to permit the split to be widened as required to permit insertion of the laminations whereafter the bobbin resumes its normal closed position.

Figure 3:
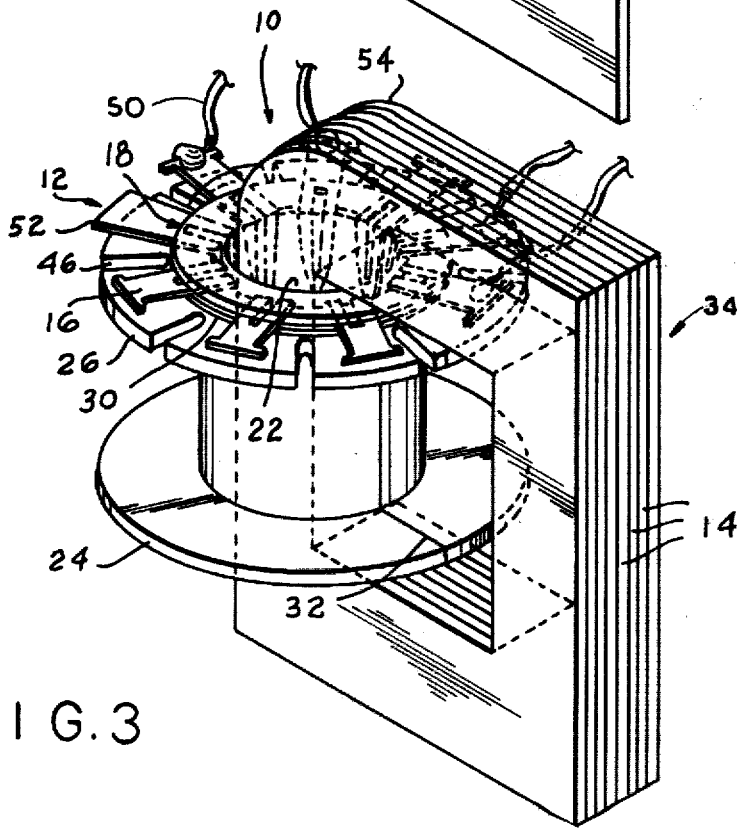
FIG. 3 is a perspective view of the miniature transformer of the present invention wherein the core is made up.

Referring to FIGS. 2 and 3, it can be noted that adjacent to each of the terminals 16 there is provided a passage or opening 46 in flange 26. A plurality of windings extend about the bobbin. Each end 48 of each winding is brought through one of the passages 46 and then wound about a terminal 16. The windings (which are not shown in detail for purpose of clarity) are generally formed of ultrathin gauge wire such as No. 52 copper wire. The connection with terminal 16 may readily been made by wrapping the end of the thin wire about the terminal. Connections with the outside may then be made with heavy gauge wire 50 soldered to the terminal 16 as shown in FIG. 3 rather than by connecting the ends 48 of the winding directly with the outside connection 50.

The assembly of the transformer 10 is as follows. Terminals 16 are positioned on rim 28 of a bobbin 12 and locked in position with cap 18. The bobbin and cap are then split in a single operation to form splits 32 and 44 simultaneously. The desired number of laminations 14 are then inserted into the bobbin to build up the core stack 34. The primary and secondary winding are then wound about the bobbin utilizing a friction drive to rotate the bobbin during the winding procedure. To this end, it is convenient to provide one terminal 52 made of a material which differs from the remaining terminals so that automatic counting equipment may be utilized to keep track of the rotations of the bobbin during the winding procedure through detection of terminal 52 during each rotation. Prior to winding, each coil, one end of the winding is secured to a terminal 16 by bringing it from the bobbin shaft through a flange opening 46. When the necessary turns are on the bobbin, the other end of the winding is brought through another passage 46 to a different terminal 16.

The laminations 14 are stamped from a suitable soft iron material. Each lamination is generally rectangular in shape, gapless, and provided with a rectangular opening. To facilitate the winding operation, the corner 54 of each lamination passed through the bobbin and directed toward the terminals is rounded. This insures that the laminations will not interfere with the friction drive of the bobbin winding equipment. It also facilitates orientation and alignment of the core stack.

After the desired number of windings is applied to the bobbin with the ends of each winding affixed to a terminal 16 as described above, the transformer may be placed in a can or casing 20. Usually the casing is formed of a material such as Mu metal to provide magnetic shielding. The open end of the casing may be closed by the end of bobbin 12 carrying terminals 16 or by a closure through which pins extend, each of the pins making contact with one of the terminals 16. The latter arrangement permits the transformer to be plugged into an appropriate socket.

Figure 4:
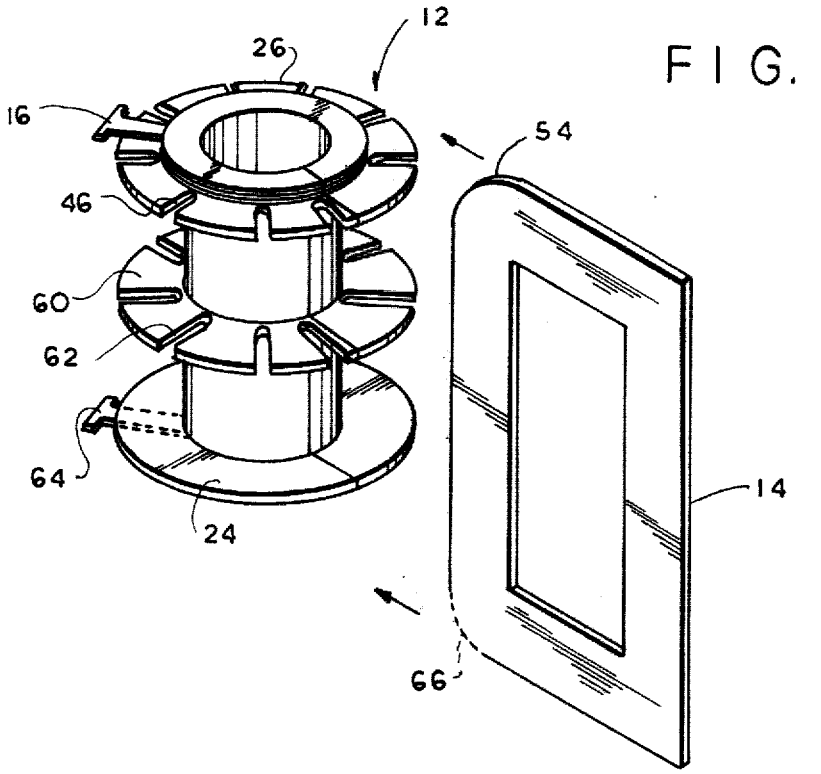
FIG. 4 is a simplified exploded perspective view of an alternate embodiment of the present invention.

In FIG. 4 a first alternative embodiment of the invention is shown in simplified form. In this embodiment, the bobbin 12 is provided with an intermediate flange 60 between flanges 24 and 26. Such a construction may be desired where, for example, it is desirable to separate the primary and secondary windings of the transformer. The construction of a transformer utilizing a bobbin such as shown in FIG. 4 is essentially the same as that described above. The bobbin must be split as before to enable the laminations to pass to the center of the bobbin. The winding (or windings) on the top half of the bobbin (i.e., between flanges 26 and 60) are brought out to terminal 17 on the top of the bobbin as in the previous description. Similarly, windings on the bottom of the bobbin may be brought out to terminals on the top of the bobbin by bringing the ends of each winding through passages 62 in flange 60 as well as passage 46 in top flange 26. Alternatively, the windings on the lower portion of the bobbin may be brought out to terminals 64 on the bottom end of the bobbin. This would require that the bottom of the bobbin be provided with a rim and cap construction comparable to that described for the transformer of FIGS. 1-3 and the top of the present bobbin. In this case, the laminations 14 would have to have their bottom corners 66 rounded off as shown in phantom on FIG. 4.

Figure 5:
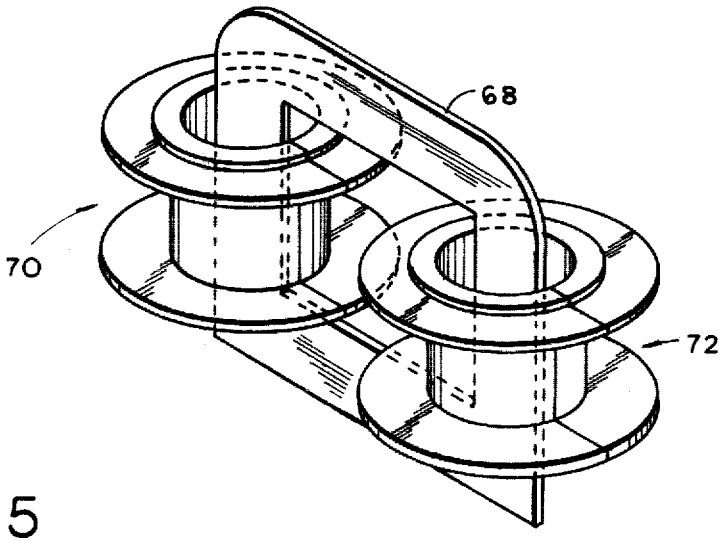
FIG. 5 is a simplified perspective view of a second alternative embodiment of a subminiature transformer in accordance with the present invention.

FIG. 5 shows another alternative embodiment of the present invention wherein two bobbins are disposed about a single stack of laminations (only one of which, 68 is shown). In this arrangement, each of the bobbins 70 and 72 is identical with the construction of the bobbin 12 of the primary embodiment.

In each of the embodiments of the present invention, the essential feature comprises the fact that the laminations are gapless and the bobbin is split to permit insertion of each lamination into the bobbin interior to build up the desired stack of laminations.

Thus, in accordance with the above, the aforementioned objectives are effectively attained.

Having thus described the invention, what is claimed is:

1. A subminiature transformer comprising:
   - a bobbin having an annular bobbin shaft having an open center section.
   - a first flange at one end of said shaft and a second flange at the opposite end of said shaft,
   - a rim extending beyond said first flange, and
   - a split extending for the entire length of said bobbin into said center section;
   - a plurality of terminal members positioned on said rim;
   - a plurality of gapless transformer core laminations forming a core stack, each of said laminations being passed through said split to link with said bobbin; and a plurality of wire coils wound about said bobbin between said flanges, each end of each said coils being connected to one of said terminals.

2. The invention in accordance with claim 1 further comprising an annular cap seated on said rim and capturing said terminal members between said rim and said cap, said cap having a split therein in registry with said bobbin split.

3. The invention in accordance with claim 1 wherein the flange adjacent said rim is provided with a plurality of passages therein, at least one passage being adjacent each one of said terminals.

4. The invention in accordance with claim 3 wherein each end of said windings is drawn through a passage into a pocket defined between the flange and rim for connection with its adjacent terminal.

5. The invention in accordance with claim 1 wherein each of said laminations is generally rectangular and the corner of each lamination passed through said bobbin and directed toward said rim is rounded.

6. The invention in accordance with claim 1 wherein one of said terminals is formed of a material different from the remaining terminals.

7. The invention in accordance with claim 1 further comprising a container encasing said bobbin.

8. The invention in accordance with claims 1, 2, 3, 5, 6 or 7 further comprising a third flange interposed between said first and second flanges and said windings are disposed partially between said first and third flanges and partially between said third and second flanges.

* * * * *